US008475233B2

(12) United States Patent
Stentenbach

(10) Patent No.: US 8,475,233 B2
(45) Date of Patent: Jul. 2, 2013

(54) DEVICE FOR GRINDING SPINNING COTS

(75) Inventor: Udo Stentenbach, Nordhorn (DE)

(73) Assignee: Rosink GmbH + Co. KG Maschinenfabrik, Nordhorn (DE)

( * ) Notice: Subject to any disclaimer, the term of this patent is extended or adjusted under 35 U.S.C. 154(b) by 762 days.

(21) Appl. No.: 12/649,365

(22) Filed: Dec. 30, 2009

(65) Prior Publication Data

US 2010/0197206 A1 Aug. 5, 2010

(30) Foreign Application Priority Data

Jan. 31, 2009 (DE) ..... 10 2009 006 965

(51) Int. Cl.
*B24B 5/37* (2006.01)

(52) U.S. Cl.
USPC ..... 451/246; 451/49; 451/334

(58) Field of Classification Search
USPC ..... 451/246, 268, 269, 49, 334
See application file for complete search history.

(56) References Cited

U.S. PATENT DOCUMENTS

| | | | | | |
|---|---|---|---|---|---|
| 1,843,414 | A | * | 2/1932 | Busch | 451/49 |
| 2,639,558 | A | * | 5/1953 | Cotchett et al. | 451/218 |
| 2,644,276 | A | * | 7/1953 | Swanson | 451/218 |
| 2,719,391 | A | * | 10/1955 | Brown | 451/397 |
| 2,735,234 | A | * | 2/1956 | Swanson | 451/218 |
| 4,422,200 | A | * | 12/1983 | Atwater | 15/88.3 |
| 2007/0042689 | A1 | | 2/2007 | Stentenbach | |

FOREIGN PATENT DOCUMENTS

DE 3226573 A1 1/1984

* cited by examiner

*Primary Examiner* — Robert Rose
(74) *Attorney, Agent, or Firm* — Gudrun E. Huckett

(57) ABSTRACT

A device for grinding spinning cots has a rotating grinding roller and a carriage that is linearly movable relative to the grinding roller. A pivot arm is pivotably supported on the carriage and movable between a loading position and a grinding position. A workpiece receptacle is mounted on the pivot arm and adapted to receive a spinning cot to be ground. A feed device is provided that is actuatable in accordance with progression of a grinding process performed on the spinning cot toward a grinding surface of the grinding roller. The pivot arm is moveable by the feed device relative to the carriage. A device is provided that is actuatable independent of the feed device for manual adjustment of the carriage into a desired linear position relative to the grinding roller.

12 Claims, 3 Drawing Sheets

DEVICE FOR GRINDING SPINNING COTS

BACKGROUND OF THE INVENTION

The invention concerns a device for grinding spinning cots, the device comprising a rotating grinding roller, a workpiece receptacle arranged on a pivot arm for receiving the spinning cot to be ground, wherein the pivot arm is supported on a carriage that is movable linearly relative to the grinding roller and is movable between a loading position and a grinding position, and comprising a feed device actuatable in accordance with the advancement or progression of the grinding process performed on the spinning cot toward the grinding surface of the grinding roller.

Such grinding machines for grinding spinning cots are disclosed in DE 32 26 573 A1 and US 2007/042689. They are used primarily in spinning mills. Here, the spinning cots, as transport rolls, have the task of guiding textile fibers. In this connection, the spinning cots are subject to great wear so that they must be reground frequently. Since the diameter of the spinning cots innately is dimensioned with oversize, they can be reground several times.

For exact regrinding on the grinding machine according to US 2007/042689, a significant control-technological expenditure is provided and this leads thus to correspondingly good grinding results. However, there are a few fields of application in which such machines are not usable or not useable within the range of their technical possibilities because their proper operation requires trained personnel and primarily specialists.

Primarily for cost reasons in smaller spinning mills and for minimal product quantities, a grinding machine for grinding spinning cots is therefore desirable that can be operated simply and intuitively while avoiding possible sources of error so that grinding results sufficient for many applications can be obtained with untrained personnel.

SUMMARY OF THE INVENTION

As a solution to the aforementioned object, a device for grinding spinning cots of the aforementioned kind is proposed in which the pivot arm, by means of the feed device, is embodied to be movable relative to the carriage and in which a device, actuatable independent of the feed device, is provided for manual adjustment of the carriage into a desired linear position.

In such a grinding machine, the individual components can be designed to be constructively simple, and, with respect to their function and operation, they are substantially intuitively operable so that an intuitive operation is possible even for untrained personnel. However, excellent grinding results can still be obtained and the quality corresponds to that of fully automated devices. This is achieved in that the feed action during the grinding process is not realized by advancing the linearly movable carriage but instead the carriage during the actual grinding process is standing still while the feed device that is manually actuated moves the pivot arm that receives the workpiece relative to the carriage. The carriage provides only a mechanical preadjustment of the maximum reachable feed location for the feed action wherein this preadjustment of the carriage during the subsequent grinding process is not changed anymore. This enables the possibility of grinding all spinning cots of a spinning machine to exactly the same final dimension after the latter has been mechanically adjusted once.

In one embodiment of the device, for realization of the feed device an eccentric drive is proposed that is integrated preferably into the pivot arm. This enables a simple and low maintenance construction that is also space-saving.

Preferably, for manual actuation of the feed device a manual lever is provided that is pivotable in the direction toward the grinding roller. This construction contributes to the intuitive operation of the grinding machine because for the operating personnel the correlation between manual actuation toward the grinding roller and the accordingly correlated grinding process is already visually apparent.

In a further embodiment, a second manual lever that is fixedly mounted on the pivot arm is proposed for pivoting the entire pivot arm. Moreover, it is proposed that the two manual levers are arranged at a spacing relative to one another so that upon operation of the device the first manual lever that pivots the pivot arm may be gripped with one hand and the other lever that effects the feeding action may be gripped with the other hand. The operation by means of two pivotable levers is simple, logical for the operator, and also contributes to the grinding machine being substantially intuitively operable.

According to a further embodiment, the feeding device is provided with a stop that mechanically limits the maximum feed stroke of the feed action.

According to a further embodiment, on the carriage the axis of rotation of a motor-driven drive roller is supported onto which the workpiece receptacle with the spinning cot can be lowered from above.

According to a further embodiment, the feed action is substantially horizontal wherein the drive roller is arranged such that the axis of the spinning cot during the course of the feed action moves across the axis of rotation of the drive roller.

Furthermore, it is proposed to provide a securing element in the form of, for example, a gas pressure spring that positions or secures the pivot arm in its loading position and in its grinding position.

BRIEF DESCRIPTION OF THE DRAWINGS

One embodiment of the invention will be explained in the following with reference to the drawings.

DESCRIPTION OF PREFERRED EMBODIMENTS

Figure 1:
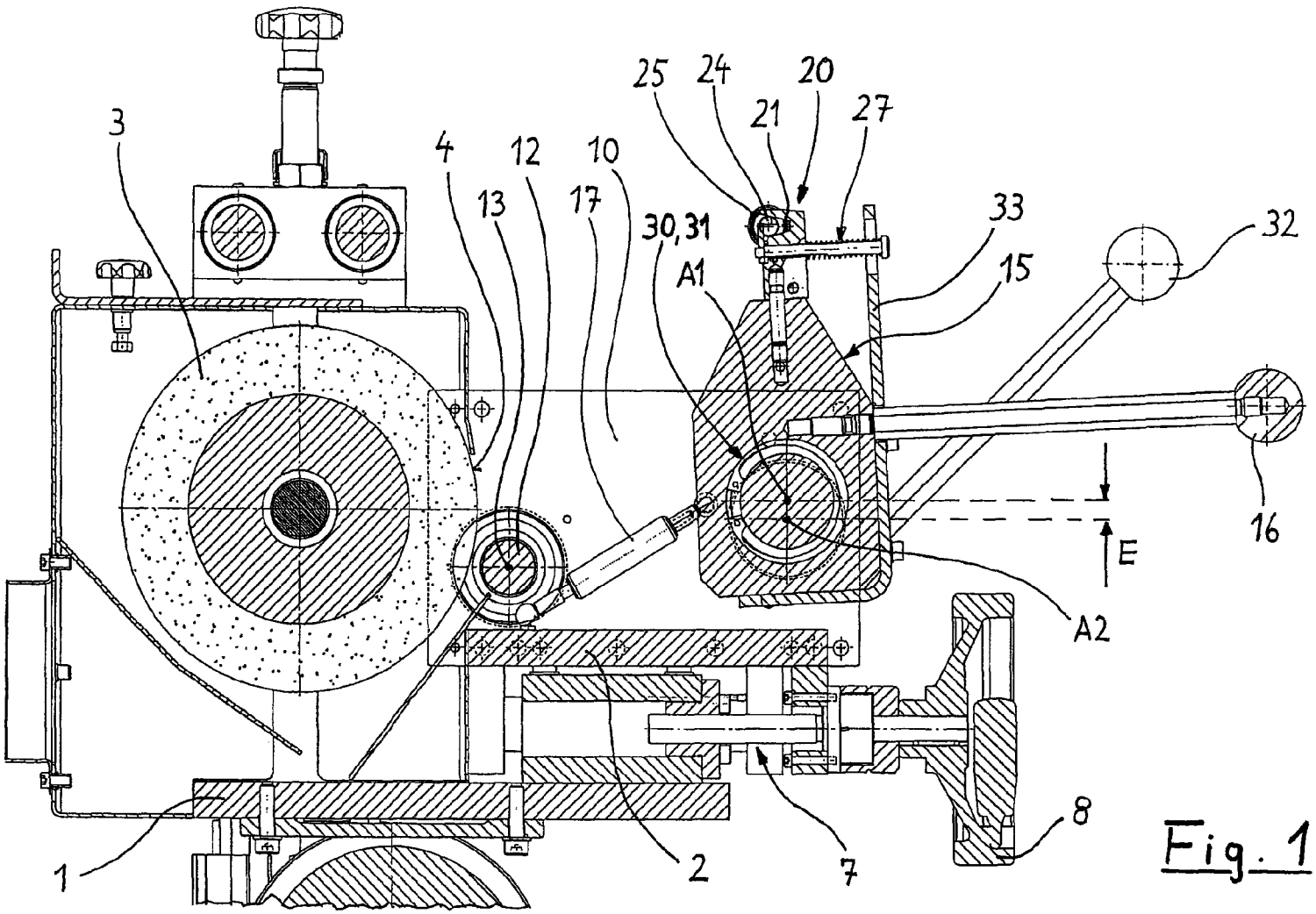
FIG. 1 is a side view of a grinding machine with a spinning cot to be ground wherein a pivot arm of the grinding machine that receives the spinning cot is illustrated in its loading position.

In the Figures, only those elements of the grinding machine are illustrated which are important in the context of the invention. Schematically illustrated is a machine table 1 that is a fixed component of a stationary machine frame. On the machine table 1 a carriage 2 is movable in a horizontal guide. For moving the carriage 2 relative to the machine table 1 a spindle drive 7 is provided that can be actuated by a hand wheel 8. The spindle drive 7 has a scale ring with a scale of preferably 0.01 mm. A micrometer screw serves for exact alignment of the carriage 2.

On the machine table 1 or the machine frame of the grinding machine a grinding roller 3 is supported that is driven by means of its own electric motor. Its outer surface forms the grinding surface 4 for grinding the spinning cot. The effective length of the grinding roller 3, i.e., its grinding surface, is longer than the length of the spinning cot to be ground. In spite of this, for achieving a uniform grinding action it may be advantageous when the grinding roller 3 during operation performs a traversing movement.

Lateral walls 10 that serve for supporting a drive roller 12 and a pivot arm 17 are part of the carriage 2 that is horizontally movable. The drive roller 12 is supported near the grinding roller 3 on the carriage 2 and its drive action is realized by means of its own electric motor. The axis of rotation 13 of the drive roller 12 is somewhat lower than the axis of rotation of the grinding roller 3. During the grinding operation the drive roller 12, as a result of friction of its surface, will cause the spinning cot that is to be ground and rests on the drive roller to be entrained in rotation such that the spinning cot is rotated opposite to the rotation of the grinding roller 3 and its surface that is contacting the grinding surface 4 is ground.

A stably designed pivot arm 15 is supported at the location of the axis A1 on the carriage 2 or on its lateral walls 10. The pivot arm 15 can be pivoted about the axis A1 of the pivot bearing about approximately 90° for which purpose a manual lever 16 is rigidly connected to the pivot arm 15. This pivot movement moves the pivot arm 15 from an upwardly projecting loading position that is illustrated in FIG. 1 into an approximately horizontal grinding position that is illustrated in FIG. 2 and in FIG. 3.

In order for the pivot arm 15 to be locked in the loading position as well as in the grinding position, a securing element in the form of a gas pressure spring 17 is supported pivotably with one end on the pivot arm 15 and with the other end on the carriage 2. The arrangement of the gas pressure spring 17 is such that it locks the pivot arm 15 in both end positions (loading position, grinding position), and such that a pivoting action or return pivot movement from these end positions by means of the manual lever 16 is possible only against increased resistance.

On the pivot arm 15, namely in the area that is farthest removed from the pivot axis A1 of the pivot bearing, there is a workpiece receptacle 20. Its important element is a bifurcated receptacle 21 that opens in a trapezoidal shape or V-shape for receiving the workpiece to be ground, i.e., a spinning cot 25. In the embodiment disclosed herein, the spinning cot 25 is a so-called top roller whose axle 24 that, in comparison to the remaining diameter of the spinning cot 25, is slim rests in a defined position in the receptacle 21 designed to have a trapezoidal shape. The spinning cot 25 is secured by a spring mechanism 27 whose pretension secures the spinning cot 25 in the workpiece receptacle 20.

Figure 2:
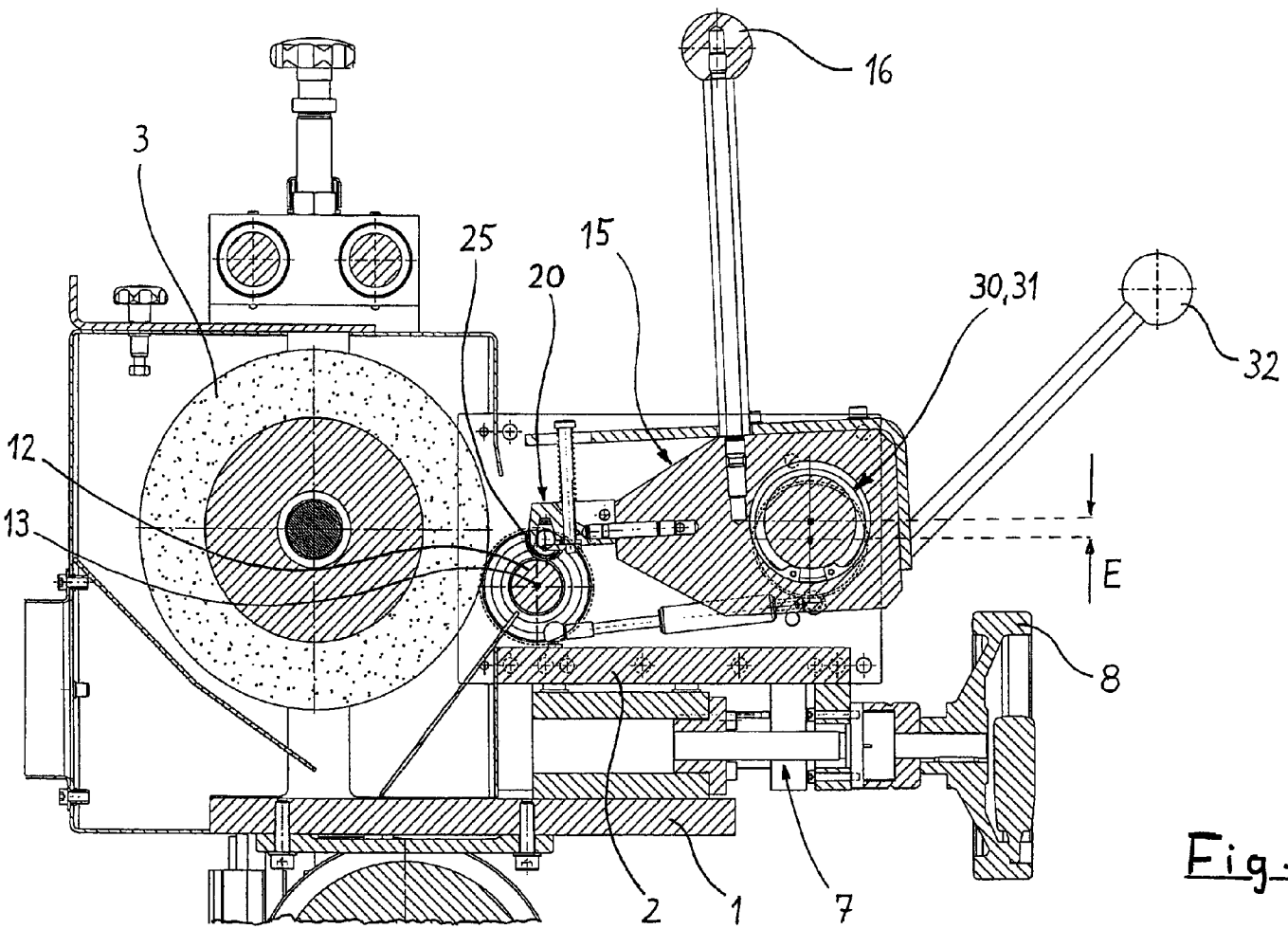
FIG. 2 shows the objects of FIG. 1 after the pivot arm has been pivoted about approximately 90° into its grinding position.

FIG. 1 illustrates the loading position of the pivot arm 15. In this connection, the workpiece receptacle 20 is at the top and in particular above the pivot axis A1 where there is enough room and free space for insertion of the respective spinning cot into the workpiece receptacle of the pivot arm.

Subsequently, the thus loaded pivot arm 15 is moved from the loading position illustrated in FIG. 1 into the position illustrated in FIG. 2 wherein the entire pivot arm 15 rotates about the axis A1 of the pivot bearing. In this way, the workpiece receptacle 20 is moved into a position above and approximately in front of the drive roller 12 and the spinning cot 25 secured in the workpiece receptacle contacts with its cylindrical outer surface the outer surface of the rotating drive roller 12. A contact of the spinning cot 25 at the grinding surface 4 of the grinding roller 3 is not yet established at this point in time.

Figure 3:
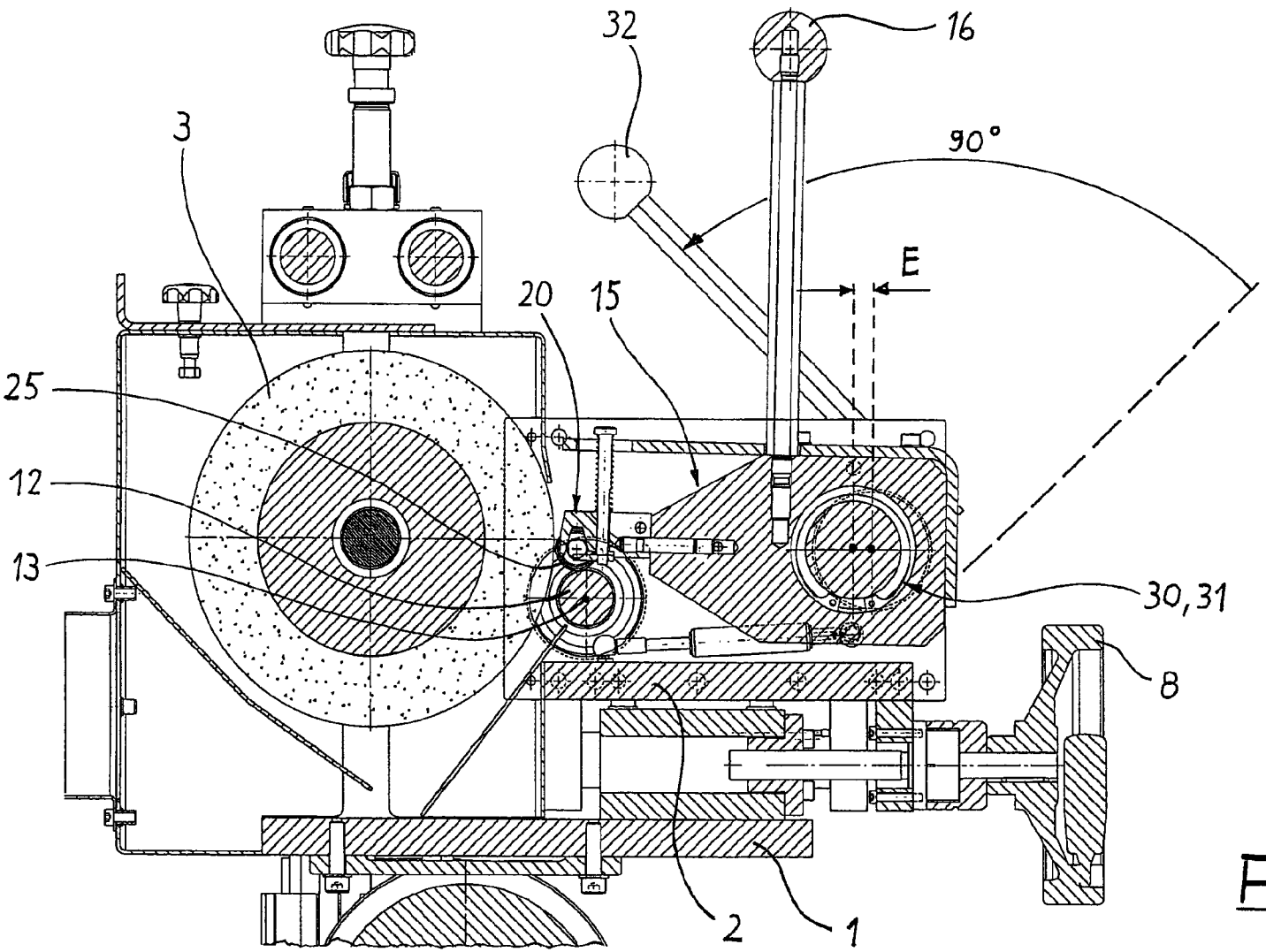
FIG. 3 shows the objects according to FIG. 2 during the grinding process.

Instead, for initiating the grinding process the workpiece receptacle 20 must be moved from the position illustrated in FIG. 2 by a substantially horizontal movement in the direction toward the rotating grinding roller 3. This so-called feed action is realized by means of the manually actuatable feed device 30 that is integrated into the pivot arm 15. The comparison of FIGS. 2 and 3 shows how the pivot arm 15 upon feed action carries out a substantially horizontal stroke between a position in which the spinning cot 25 is not yet in contact with the grinding roller 3 and a position in which the spinning cot 25 driven by the drive roller 12 arranged below is ground by the grinding roller 3. During the course of the feed action the axis of the spinning cot 25 moves across and past the axis of rotation 13 of the drive axis 12.

The technical realization of the feed action is realized by an eccentric drive 31 which is integrated constructively into the pivot bearing of the pivot arm 15. According to FIG. 1, the axis A2 of the eccentric is displaced by the eccentricity E relative to the axis A1 about which the pivot arm 15 pivots. Upon rotation of the eccentric drive 31 about 90°, a horizontal feed action of the magnitude E is realized. For manual actuation of the eccentric drive 31 a second manual lever 32 is provided. It is arranged such that during the feed action a pivot movement in the direction of the grinding roller 3 is carried out. A movement oriented in this way is suitable in a special way to even visually indicate to the operator of the grinding machine the feed action during the grinding process.

With a corresponding design of the eccentric drive, the feed device 30 is provided with a mechanically limiting stop that delimits a maximum feed stroke. When reaching this stop, a further feed stroke is no longer possible. In this way, it is prevented that, as a result of an excessive feed action of the workpiece receptacle 20 arranged on the pivot arm 15, a higher than predetermined degree of grinding will be performed. The adjustment of the grinding removal is realized instead beforehand by an appropriate horizontal positioning of the carriage 2. For this purpose, the carriage 2 is movable by means of the spindle drive 7 at a right angle to the axis of rotation of the grinding roller 3 and the axis of rotation 13 of the drive roller 12 wherein the movement path of the carriage 2 is arranged lower than these axes of rotation. The thus adjusted carriage position must not be changed anymore even when other spinning cots 25 of the same type are to be ground. Instead, with a complete pivoting of the manual lever 32 up to the mechanically preset stop the feed stroke is carried out to its maximum and a further feed action is then blocked.

The two manual levers 16, 32 are arranged at a spacing relative to one another. In this way, the operator can grip the manual lever 16 with the left hand and the other manual lever 32 with the right hand and guide them in this way. With the left hand the pivot arm 15 is therefore pivoted out of its loading position according to FIG. 1 into the position according to FIG. 2. Subsequently, with the right hand by pivoting of the second manual lever 32 the feed action, first to the beginning of the grinding process, is realized and then also the further feed action in accordance with the progression of the grinding process is realized. Because the manual lever 32 rests briefly at the stop at the end of the feed action, the spinning cot will be finish-ground. In this way, without any feeding force a fine grinding action is realized until nothing more is removed from the spinning cot. This results in an improved surface and more precise diameter.

For protecting the operator, on the pivot arm 15 a transparent protective panel 33 is mounted. The grinding machine can furthermore be provided with an attached dressing diamond that can be advanced by means of a knob and a fine thread. As needed, the dressing diamond is moved by hand slowly across the grinding roller 3 until no removal occurs anymore.

Optionally, a suction device may be furthermore provided that continuously removes by suction the grinding dust.

The specification incorporates by reference the entire disclosure of German priority document 10 2009 006 965.8 having a filing date of Jan. 31, 2009.

While specific embodiments of the invention have been shown and described in detail to illustrate the inventive principles, it will be understood that the invention may be embodied otherwise without departing from such principles.

What is claimed is:

1. A device for grinding spinning cots, the device comprising:

a rotating grinding roller;

a carriage linearly movable relative to the grinding roller;

a pivot arm pivotably supported on the carriage and movable between a loading position and a grinding position;

a workpiece receptacle mounted on the pivot arm and adapted to receive a spinning cot to be ground;

a feed device actuatable in accordance with progression of a grinding process performed on a spinning cot toward a grinding surface of the grinding roller, wherein the pivot arm is moveable by the feed device relative to the carriage;

a device actuatable independent of the feed device for manual adjustment of the carriage into a desired linear position relative to the grinding roller.

2. The device according to claim 1, wherein the feed device is an eccentric drive.

3. The device according to claim 2, wherein the eccentric drive is integrated into the pivot arm.

4. The device according to claim 1, comprising a first manual lever acting on the feed device for manual actuation of the feed device.

5. The device according to claim 4, wherein the first manual lever is pivotable in a direction toward the grinding roller.

6. The device according to claim 4, comprising a second manual lever that is rigidly connected to the pivot arm for pivoting the pivot arm.

7. The device according to claim 1, wherein the carriage is movable at a right angle relative to the axis of rotation of the grinding roller, wherein a movement path of the carriage is arranged lower than the axis of rotation of the grinding roller.

8. The device according to claim 1, wherein the feed device is provided with a stop that mechanically limits a maximum feed stroke of a feed action of the feed device.

9. The device according to claim 1, comprising a motor-driven drive roller that is supported on the carriage, wherein the workpiece receptacle with a spinning cot received therein is adapted to be lowered from above onto the drive roller.

10. The device according to claim 9, wherein a feed action of the feed device is substantially horizontal and wherein the drive roller is arranged such that the axis of the spinning cot received in the workpiece receptacle moves across the axis of rotation of the drive roller during the course of the feed action.

11. The device according to claim 1, comprising a securing element that secures the pivot arm in the loading position and in the grinding position, respectively.

12. The device according to claim 11, wherein the securing element is a gas pressure spring.

* * * * *